US005613265A

United States Patent [19]

Gemmell

[11] Patent Number: 5,613,265

[45] Date of Patent: Mar. 25, 1997

[54] PAINT ROLLER ASSEMBLY

[76] Inventor: Wayne Gemmell, 2520 Paqua Street, Regina, Saskatchewan, Canada, S4S 0M2

[21] Appl. No.: 386,522

[22] Filed: Feb. 6, 1995

[51] Int. Cl.[6] ..... B05C 17/02

[52] U.S. Cl. ..... 15/230.11; 15/144.1; 492/13; 492/19

[58] Field of Search ..... 15/230.11, 144.1; 492/13, 19

[56] References Cited

U.S. PATENT DOCUMENTS

| | | | |
|---|---|---|---|
| 2,766,473 | 10/1956 | Thackara | 15/230.11 |
| 3,447,184 | 6/1969 | McGinley . | |
| 3,866,257 | 2/1975 | Cansdale . | |
| 4,467,509 | 8/1984 | Dezen | 492/13 |
| 4,528,714 | 7/1985 | Beck | 492/13 |
| 4,541,140 | 9/1985 | Allison . | |
| 4,985,959 | 1/1991 | Lieberman et al. | 492/13 |
| 5,090,084 | 2/1992 | De Guzman | 15/230.11 |
| 5,207,755 | 5/1993 | Ampian | 492/13 |

FOREIGN PATENT DOCUMENTS

| | | | |
|---|---|---|---|
| 517507 | 10/1955 | Canada . | |
| 857558 | 12/1970 | Canada . | |
| 1202276 | 3/1986 | Canada . | |
| 693442 | 3/1986 | Canada . | |
| 2075575 | 5/1993 | Canada . | |
| 0922693 | 1/1955 | Germany | 15/230.11 |
| 2155147 | 9/1984 | United Kingdom | 15/230.11 |

*Primary Examiner*—David Scherbel
*Assistant Examiner*—James F. Hook

[57] ABSTRACT

A paint roller assembly for applying paint to surfaces, having a sealed chamber interior to a replaceable paint roller to prevent paint infiltration into the moving parts of the roller. The paint roller assembly is further provided with an articulated bayonet quick mount connector to permit the paint roller apparatus to be quickly mounted on extension handles thereby permitting the operator of the paint roller to extend the reach of the paint roller to high walls and overhead surfaces such as pipes and ducts without requiring a ladder or scaffolding.

7 Claims, 4 Drawing Sheets

PAINT ROLLER ASSEMBLY

FIELD OF THE INVENTION

This invention relates to apparatus for applying paint to surfaces and in particular to paint roller assemblies at apply paint to a surface by rolling contact with the surface.

BACKGROUND OF THE INVENTION

In apparatus for applying paint to surfaces using rollers, there is typically provided a disposable porous surfaced roller element which transfers paint from a paint tray to the surface to be painted. The roller element is retained on the handle using a friction fit or interference snap on fit retaining the roller on the handle, or roller cage as it is commonly referred to, while permitting the roller element to rotate freely about the roller cage. Operation of available roller apparatus results in the roller element becoming increasing harder to roll and successfully apply paint as the interior chamber of the roller element becomes filled with paint which accumulates over time fouling the rotating pieces of the roller apparatus.

Also, it is common to provide a threaded receiving bore in the end of the handle of the roller assembly to permit the roller assembly to be mounted on an extension handle to allow the painter to apply paint to high walls without the need to set up ladders or scaffolding. While this is a great convenience, extension handles and mounting systems that have heretofor been used do not permit the roller apparatus to apply paint to overhead structures such as heating ducts or piping which require the paint to be applied to the top surface thereof. When painting such overhead structures as these it is necessary to once again resort to setting up ladders and scaffolding to permit the painter to climb up to the surface to be painted. This adds to the equipment and time needed to paint such surfaces.

SUMMARY OF THE INVENTION

A general object of this invention is to provide a sealed paint roller system which is convenient and easy to use which will enable a paint roller to be used without having the nuisance of paint entry into the interior chamber of the paint roller to harden there and make multiple uses of the painting sleeve difficult due to the accumulation of paint between the moving parts of the paint roller.

It is a further object of this invention to provide an articulated pole mount for the paint roller cage which enables the paint roller to rotate against the surface to be painted at any suitable angle relative to the line defined by the pole, such as orthogonal—which is the customary angle, as well as parallel or any angle in between to allow the paint roller to apply paint to overhead pipes and ducts while the paint roller is mounted on a pole thereby avoiding the need to use scaffolding or ladders to paint such items.

It is another object of this invention to provide an articulated pole mount for the paint roller which is quick and easy to use yet prevents the paint roller cage assembly from rotating on the pole.

Traditional poles mounts provided in paint rollers require that the paint roller cage be threaded onto the end of the pole. Such a configuration is workable when the rotation of the paint roller relative to the pole is orthogonal. However such a mount is disadvantageous when an articulated mount is used. An articulated mount will enable the paint roller to roll against the surface to be painted at other angles than the traditional right angle to the pole thereby permitting the painter to apply paint to overhead objects such as pipes and ducts and the like. However, a conventional prior art threaded pole mount is not suitable for providing an articulated roller cage relative to the pole as a torque will be induced between the roller cage and the pole which would cause the roller cage to uncouple from the pole during the painting process.

In one of its aspects the invention provides: a releasable mount assembly for a paint roller sleeve comprising: a cylindrical insert dimensioned to frictionally engage the inside surface of one end of a paint roller sleeve, having a closed face at one end there of and a receiving bore extending coaxially inwardly from the other face thereof said bore including a circumferential detent of a larger radius than that of the receiving bore; a tubular axle member dimensioned to slide inside the bore of said cylindrical insert permitting rotation of said insert thereabout wherein one end of said axle member is provided with diametrically opposed holes in mating alignment with the circumferential detent of said cylindrical insert; at least one retaining spring element having 2 opposing protrusions, said spring being compressible whereby said protrusions fit into the interior of said tubular axle member and released when the protrusions align with the holes of said tubular axle member to extend radially outwardly therethrough to spacedly engage the circuferential detent of said first insert when mounted on said tubular axle member.

In another of its aspects, the invention provides: a releasable mount assembly for a paint roller sleeve comprising: a first cylindrical insert dimensioned to frictionally engage the inside surface of one end of a paint roller sleeve, having a closed face at one end there of and a receiving bore extending coaxially inwardly from the other face thereof said bore including a circumferential detent of a larger radius than that of the receiving bore; a second cylindrical insert dimensioned to frictionally engage the inside surface of the other end of said paint roller sleeve having a bore extending coaxially entirely therethrough; a tubular axle member dimensioned to slide inside the bore of each said insert permitting rotation of each insert thereabout wherein one end of said axle member is provided with diametrically opposed holes in mating alignment with the circumferential detent of said first insert and the other end of said axle member is provided with an annular circumferential detent of smaller radius than said axle member located on said axle member to be positioned within the bore of said second cylindrical insert when rotatably mounted on said axle member; at least one retaining spring element having 2 opposing protrusions, said spring being compressible whereby said protrusions fit into the interior of said tubular axle member and released when the protrusions align with the holes of said tubular axle member to extend radially outwardly therethrough to spacedly engage the circuferential detent of said first insert when mounted on said tubular axle member; an o-ring sealing element disposed in said annular circumferential detent of said axle member whereby a rotatable seal is created between the axle member and the bore of said second cylindrical insert.

In yet another of its aspects the invention provides: An articulated-joint pole mount assembly for a paint roller comprising: an elongated grip engaging member having a keyed element extending from one end thereof adapted to slideably receive a mating keyed element provided on the grip of paint roller handle, including securing means to secure said keyed element of said grip engaging member to said mating keyed element provided on the grip of said paint roller handle in place; an elongated pole engaging member one end of which being adapted to slideably receive an extension pole therein, said pole engaging member further including securing means to secure said pole in place when inserted into said pole engaging member; a swivel joint assembly connected to said grip engaging member and said pole engaging member whereby a selected relative angle between the two elongated members may be set including adjustable locking means operable to lock the selected angle set between the two elongated members.

In yet another of its aspects the invention provides: An articulated-joint extension pole mount assembly for a paint roller handle and extension pole system comprising: an elongated adapter assembly having a keyed element extending from one end thereof adapted to slideably receive a mating keyed element provided on the grip of paint roller handle, including securing means to secure said keyed element of said grip engaging member to said mating keyed element provided on the grip of said paint roller handle in place and a pole engaging element extending from the other end of said assembly said pole engaging element adapted to slideably receive a pole means therein, including securing means to secure said pole means in place when inserted into said pole engaging element; at least one swivel joint assembly providing pole means extending longitudinally in one direction and a pole engaging element extending longitudinally in another direction including securing means to secure a pole means slideably received therein whereby a selected relative angle between the two longitudinally extending members may be set including adjustable locking means operable to lock the selected angle set between the two longitudinally extending members whereby the pole means of one swivel joint assembly is engaged by the pole engaging element of said adapter assembly and an extension pole is engaged by the pole engaging element of one swivel joint assembly to articulate a paint roller handle relative to an extension pole.

In yet a further aspect of the invention there is provided: a paint roller and extension pole system comprising: a cylindrical insert dimensioned to frictionally engage the inside surface of one end of a paint roller sleeve, having a closed face at one end there of and a receiving bore extending coaxially inwardly from the other face thereof said bore including a circumferential detent of a larger radius than that of the receiving bore; a tubular axle member dimensioned to slide inside the bore said cylindrical insert permitting rotation of said insert thereabout wherein one end of said axle member is provided with diametrically opposed holes in mating alignment with the circumferential detent of said first insert; a retaining spring element having 2 opposing protrusions, said spring being compressible whereby said protrusions fit into the interior of said tubular axle member and released when the protrusions align with the holes of said tubular axle member to extend radially outwardly therethrough to spacedly engage the circuferential detent of said first insert when mounted on said tubular axle member; an elongated grip engaging member having a keyed element extending from one end thereof adapted to slideably receive a mating keyed element provided on the grip of paint roller handle, including securing means to secure said keyed element of said grip engaging member to said mating keyed element provided on the grip of said paint roller handle in place; an elongated pole engaging member one end of which being adapted to slideably receive an extension pole therein, said pole engaging member further including securing means to secure said pole in place when inserted into said pole engaging member, said elongated pole engaging member having a swivel joint at the other end thereof; a swivel joint assembly connected to said grip engaging member and said pole engaging member whereby a selected relative angle between the two elongated members may be set including adjustable locking means operable to lock the selected angle set between the two elongated members.

BRIEF DESCRIPTION OF THE DRAWINGS

A detailed description of the preferred embodiment of the invention now follows with reference to the drawings in which.

DESCRIPTION OF THE PREFERRED EMBODIMENT

Figures 1, 3:
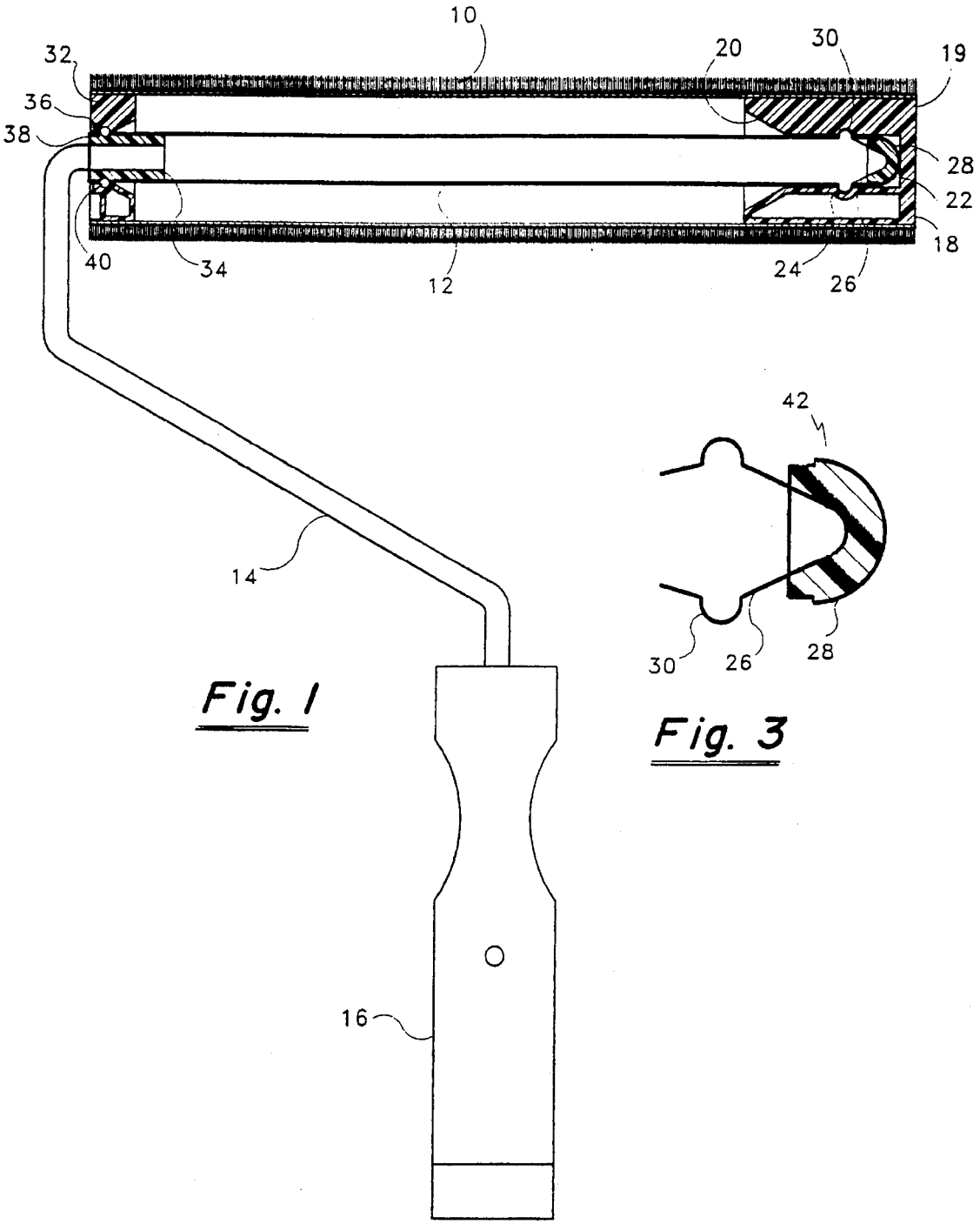
FIG. 1 is a cut away plan view of the preferred embodiment of the paint roller assembly.
FIG. 3 is an enlarged cross sectional view of the retention spring and end cap assembly.

A detailed description of the preferred embodiment of the invention together with useful variations thereof now follows with reference to like features of the invention bearing the same reference numerals in the Figures throughout.

Referring now to FIG. 1 which is a cut away plan view of a paint roller assembly in accordance with the present invention, there is shown a conventional replaceable sleeve element 10 that is cylindrical in shape and is provided with a porous mat material on the exterior surface to absorb paint from a tray prior to application to a surface to be painted through rolling contact with that surface. Interior to the sleeve 10 is tubular member running coaxially with the sleeve 10 and acts as axle member for the sleeve denoted by reference numeral 12. A handle 14 extends from one end of the axle 12 and the combination of the handle 14 and axle 12 are generally referred to in the trade as the roller cage. At the operator's end of the handle 14 is a grip 16 that is designed to be held in hand by the operator of the paint roller assembly. Grip 16 includes a bayonet mount assembly which will be explained in more detail with reference to subsequent Figures herein.

The far end of sleeve 10 is fitted with a cylindrical end insert 18 which is dimensioned to be pressed into sleeve 10 to firmly, frictionally engage the interior of the sleeve resulting in a seal being established between the sleeve 10 and insert 18 thereby preventing any paint from entering into the interior of sleeve 10. Insert 18 is provided with a receiving bore 22 running axially along a substantial portion of the interior of insert 18 to slideably and rotatably receive the axle 12. The exterior facing portion of end insert 18 has a substantially flat face 19 which prevents any paint from entering therethrough. Receiving bore 22 is provided with an annular engagement detent 24 formed or machined radially therein forming a spaced mating surface for retention spring 26 relative to the axle 12 preventing the sleeve from moving axially relative to the axle when it is mounted thereon. It is not necessary but very convenient to provide a conical receiving bezel 20 on the interior portion of the end insert 18 to guide the end of axle 12 into receiving bore 22 when the sleeve 10 and mounted end insert 18 are inserted onto the axle 12.

Retention spring 26 is inserted into the open end of axle 12 and the spring runs along a portion of the interior thereof. The axle itself has at least one pair of diametrically opposed holes through which retention spring protrusions 30 can pass, the said holes being located near the end of the tubular axle member 12 and align with the annular engagement detent 24 of the insert 18 when the sleeve 10 is mounted on the paint roller assembly. Also shown is an axle end cap 28 which is not essential to the operation of the invention but is preferable as it prevents the retention spring 26 from being inserted too far into the tubular axle 12. Where an end cap 28 is employed, the retention spring 26 is permanently mounted in end cap 28.

At the other end of the roller sleeve 10 there is provided a receiving insert 32 which is dimensioned to be pressed into sleeve 10 to firmly, frictionally engage the interior of the sleeve resulting in a seal being established between the sleeve 10 and receiving insert 32 thereby preventing any paint from entering into the interior of sleeve 10. Receiving insert 32 has a large bore running axially completely through the interior of insert 32 which bore is dimensioned to slideably receive axle member 12 and permit rotation of receiving insert 32 therearound. Axle 12 is provided with an annular detent 38 running circumferentially therearound and positioned in said detent 38 is a an o-ring seal 40 which provides a rotating seal between the axle 12 and receiving insert 32 thereby preventing the entry of paint into the interior chamber defined by the sleeve 10 during painting.

A mating annular detent 36 may additionally be provided in the bore of receiving insert 32 in radial correspondence to annular detent 38 of the axle to provide further snap-in-place retention of the sleeve assembly (comprising the receiving insert 32, roller sleeve 10 and end insert 18) to the axle by virtue of the O-ring popping into the corresponding annular detent 36 of the receiving insert. The roller sleeve 10 will be replaced with a new sleeve as paint colours change or sleeve wear due to use requires it. The sleeve 10, with inserts 18 and 32 mounted therein, is slid onto axle 12 and the end of axle 12 is inserted into receiving bore 22 until the retention spring 26 pops spring protrusions 30 into the mating engagement detent 24 to releasably yet rotatably engage the sleeve assembly on the roller cage assembly. Simultaneous with spring protrusions 30 popping into mating engagement detent 24, o-ring seal 40 will pop into receiving insert detent 36 if that detent has been provided. To facilitate quick and easy reception of axle 12 into bore 22 of the end insert 18, it is preferable to provide a conical receiving bezel 20 on the interior face of end insert 18 to guide the axle toward receiving bore 22.

Figure 2:
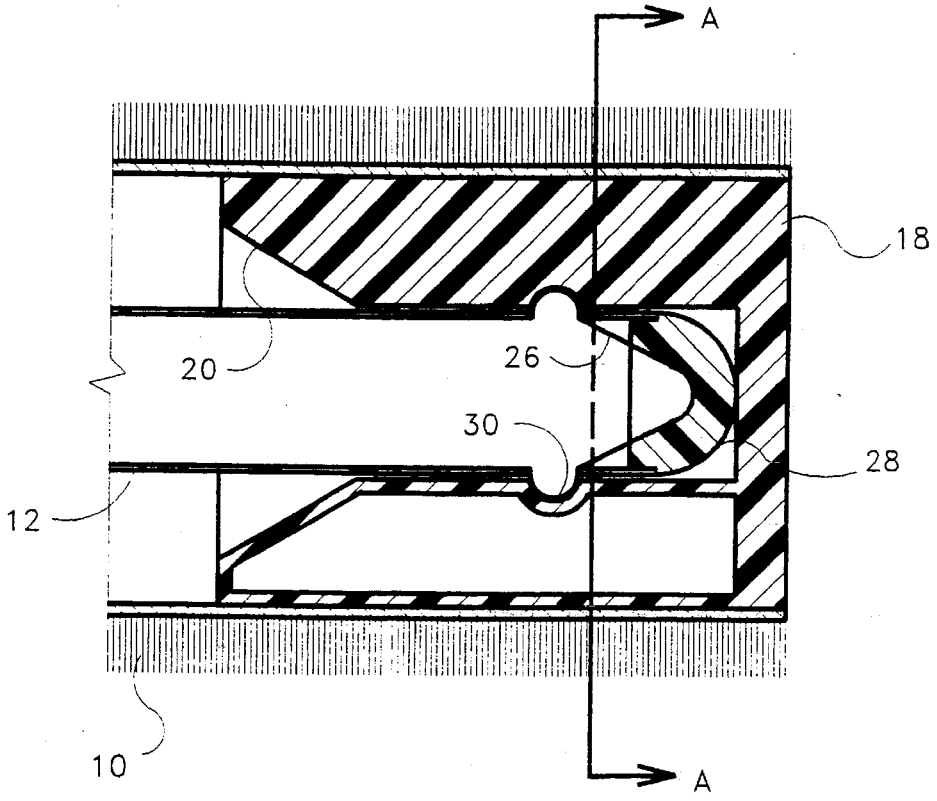
FIG. 2 is an enlarged cross sectional view of the closed end portion of the paint roller sleeve.
Figure 2A:
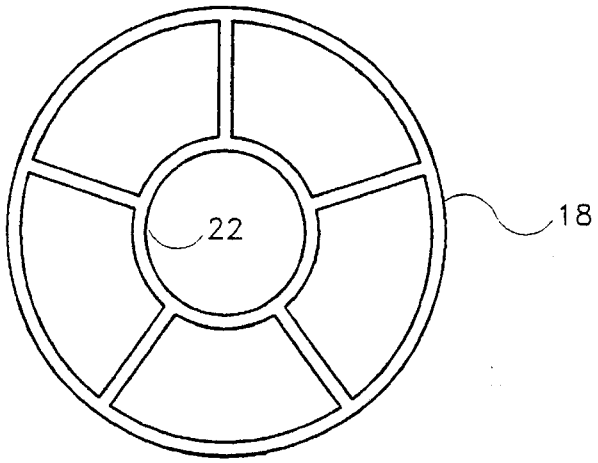
FIG. 2*a* is a radial cross sectional view taken along cutting line AA of FIG. 2.

Referring now to FIG. 2 which shows an enlarged cross-sectional view of the closed end portion of the roller assembly of FIG. 1. End insert 18 is preferably constructed of plastic material and provided with spoking in the interior thereof to minimise the amount of plastic required for construction of the insert itself. FIG. 2*a* shows a radial cross sectional view taken along cutting line AA of FIG. 2 to exemplify a possible spoking configuration of insert 18 for reduction of the weight and plastic material requirements in construction of the insert.

Referring to FIG. 3 there is shown an enlarged cross sectional view of the retention spring and end cap assembly shown removed from the axle member 12. The end cap 28, if present, is preferably constructed of plastic and is provided with a shoulder 42 dimensioned to be slid into the interior of the tubular axle 12. The retention spring 26 is formed of spring steel and is permanently mounted in end cap 28 preferably by placing the retention spring into the end cap 28 when the plastic forming the end cap element is being formed thereby permitting the retention spring to be permanently retained by the end cap when the plastic hardens. The retention spring 26 has protrusions 30 formed therein which expand to pass through corresponding diametrically opposed holes near the end of axle 12. When the end cap is mounted in the axle member, the retention spring protrusions 30 pop through the holes provided in the tubular axle member 12 and extend outwardly therefrom enabling the retention spring 26 (and end cap 28, if present) to be snapably retained in the axle 12.

Figure 4:
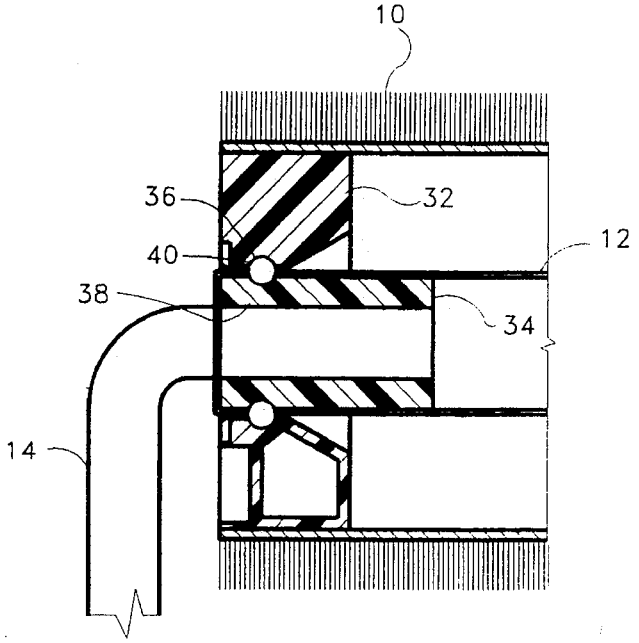
FIG. 4 is an enlarged cross sectional view of the receiving end portion of the paint roller sleeve.
Figure 4A:
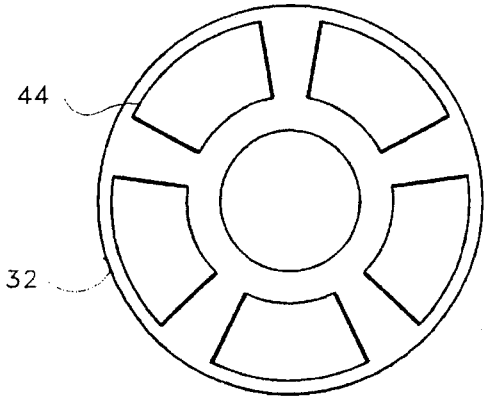
FIG. 4*a* is an exterior end view of the receiving insert.
Figure 4B:
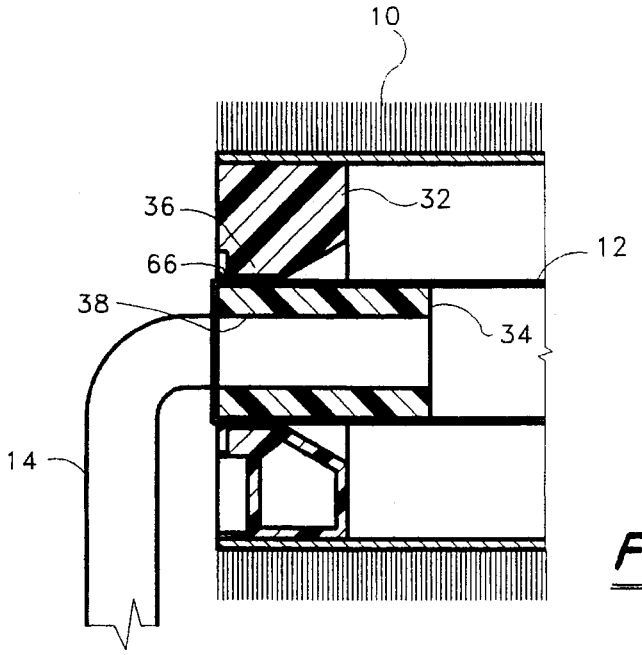
FIG. 4*b* is an exterior end view of an alternate embodiment of the receiving insert.

Referring now to FIG. 4 there is shown an enlarged cross sectional view of the receiving end portion of the roller assembly of FIG. 1. Receiving insert 32 is preferably fashioned from plastic similar to insert 18 and can be provided with interior spoking to minimise consumption of plastic in construction of same as was explained in relation to the other insert 18 with reference to FIG. 2*a*. Tubular axle member 12 mates with handle 14 by means of a collar 34 which is permanently rigidly attached to both the handle 14 and the tubular axle member 12. Near the exterior portion of the roller sleeve assembly 10 a collar detent 38 is shown which may be pressed into and around the circumference of tubular axle member 12 to provide a permanent compression fit of these 3 elements. Typically, axle 12 will be constructed from a sturdy metal material as will be handle 14. Collar 34 would be constructed from plastic or a relatively malleable metal such as aluminium. To assemble these 3 elements, the collar is positioned within the tubular axle member 12 and the handle 14 placed into the interior of the collar 34 and thereafter a circumferential depression is formed on the surface of the tubular axle member 12 to construct the axle detent 38 and also permanently mount the collar 34 on the handle 14 and tubular axle member 12. The axle detent 38 should be deep enough to permit O-ring seal 40 to be seated within the axle detent 38 such that the O-ring seal element 40 remains in the axle detent 38 when the roller assembly is slideably removed from the roller cage assembly.

Where it is desirable to have tubular axle member remain smooth (i.e. no annular indentation as shown in the seal arrangement of FIG. 4B), assembling these 3 elements, requires the collar to be positioned within the tubular axle member 12 which is enlarged at one end to receive the collar 34 therein and handle 14 placed into the interior of the collar 34. Thereafter the enlarged end of axle 12 is rotatably compressed to return it to the same diameter as the remainder of the axle thereby permanently mounting the collar 34 on the handle 14 and tubular axle member 12.

Referring now to FIG. 4*a* which shows an exterior end view of receiving insert 32. Receiving insert 32 is provided with a plurality of spinner lock depressions 44 spacedly deposed along the exterior radial surface of insert 32 proximate to the circumference thereof. The spinner lock depressions 44 enable a paint roller spinner (not shown) to engage the roller sleeve assembly (roller sleeve assembly refers to a roller sleeve 10 having insert 18 and receiving insert 32 mounted therein) enabling the spinner to quickly rotate the roller sleeve assembly to toss paint or a cleaning agent from the roller 10 to permit it to be cleaned.

Referring now to FIG. 4*b* which shows an exterior end view of an alternate embodiment of receiving insert 32. Receiving insert 32 is provided with a plurality of spinner lock depressions 44 spacedly deposed along the exterior radial surface of insert 32 proximate to the circumference thereof. The spinner lock depressions 44 enable a paint roller spinner (not shown) to engage the roller sleeve assembly (roller sleeve assembly refers to a roller sleeve 10 having insert 18 and receiving insert 32 mounted therein) enabling the spinner to quickly rotate the roller sleeve assembly to toss paint or a cleaning agent from the roller 10 to permit it to be cleaned. In place of a sealing o-ring, insert 32 is provided with an annular seal 66 in sealing contact with sleeve axle 12. Annular seal 66 is formed integrally with insert 32 from the same plastic material as the insert.

Figure 5:
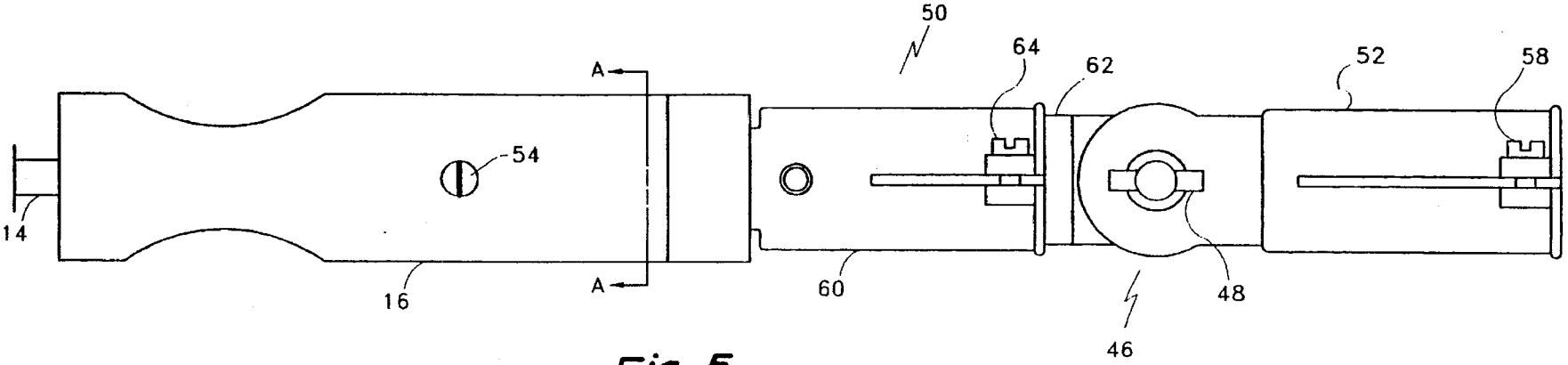
FIG. 5 is a plan view of an articulated pole mount.
Figure 5A:
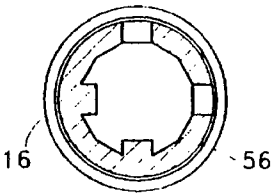
FIG. 5*a* is a cross sectional view taken along cutting line AA of FIG. 5.

Referring now to FIG. 5 which shows an articulated pole mount for use mounting the paint roller on an extension pole (not shown). Grip 16 is provide with a receiving bore to engage a articulated pole mount assembly 46 in a quick release fashion commonly referred to as a bayonet mount. The articulated pole mount 46 is provided with a grip engaging member 50 and a pole engaging member 52 that intersect at a swivel joint which is locked into a selected angle therebetween by tightening lock nut 48. The relative angle depicted in FIG. 5 is 0 degrees, however, the relative angle possible between the grip engaging member 50 and the pole engaging member 52 can run from 0 degrees up and past 90 degrees to enable the paint roller to assume various angles with respect to a pole (not shown) that it is mounted on. The articulated pole mount 46 is rigidly deposed within the interior of grip 16 by means of a set screw 54 which is tighten to hold the articulated pole mount which is slideably received therein. Preferably, the grip 16 is provided with a keyed receiving bore 56 which is illustrated as being keyed by means of a keyed octagonal receiving bore adapted to slideably receive a corresponding keyed octagonal extension of the grip engaging member 50. Other forms of keying may be used, such as rectangular, square, or complex geometric which are not explicitly illustrated in the example cross sectional view of FIG. 5*b* taken along cutting line BB of FIG. 5.

Pole engaging member 52 has a receiving bore in the interior thereof for receiving a pole (not shown) therein. Once the pole is inserted into the interior of the pole engaging member 52, a set screw 58 can be tightened to firmly, compressibly engage the pole within the articulated pole mount 46.

It is possible to provide an 3 piece configuration for the articulated pole mount 46 which is what is shown in FIG. 5. Such a configuration splits the grip engaging member into 2 parts being a roller cage adapter 60 and a joint mount 62 slideably retained therein. The mating of the roller cage adapter 60 to the joint mount 62 is secured by a set screw 64 which causes the inside diameter of the cage adapter 60 to decrease and thereby firmly and securely grip the joint mount 62 preventing any relative movement between these two elements. By constructing the articulated joint in this fashion, it is possible for the pole to be directly mounted in the cage adapter 60 directly, eliminating the articulate joint altogether when that is desired. Moreover, multiple articulated joint assemblies comprising the joint mount 62, pole engaging member 52 and lock nut 48 can be staged between the paint roller and the pole to permit very large diameter overhead ducting to be painted by displacing the roller from the pole by increasing distances depending on the number of stages of articulated joints that are employed and the actual lengths of the joint mount element 62.

While the invention has been described in terms of the preferred embodiment, it should be clearly understood that the invention is subject to numerous modifications and mechanical equivalents which do not depart from its scope as defined by the claims appended hereto.

The embodiments of the invention in which an exclusive property or privilege is claimed or defined as follows:

1. A releasable mount assembly for a paint roller sleeve comprising:

(a) a cylindrical insert dimensioned to frictionally engage the inside surface of one end of a paint roller sleeve, having a closed face at one end there of and a receiving bore extending coaxially inwardly from the other face thereof said bore including a circumferential detent of a larger radius than that of the receiving bore;

(b) a tubular axle member dimensioned to slide inside the bore of said cylindrical insert permitting rotation of said insert thereabout wherein one end of said axle member is provided with diametrically opposed holes in mating alignment with the circumferential detent of said cylindrical insert;

(c) at least one retaining spring element having two opposing protrusions, said spring being compressible whereby said protrusions fit into the interior of said tubular axle member and released when the protrusions align with the holes of said tubular axle member to extend radially outwardly therethrough to spaceally engage the circuferential detent of said first insert when mounted on said tubular axle member.

2. Apparatus as claimed in claim 1 wherein said cylindrical insert further includes a conical receiving bezel on the opposite end of the cylinder from the closed face, said bezel extending in decreasing radius from the end of said insert conically coaxially inwardly aligning with said receiving bore.

3. Apparatus as claimed in claim 1 or 2 wherein said retaining spring element is provided with an end cap element fixedly attached thereto forming a revolution surface having a cylindrical portion and shoulder portion, said cylindrical portion adapted to be slideably received by said tubular axle and shoulder portion to mate with that end of said tubular axle provided with said diametrically opposed holes.

4. A releasable mount assembly for a paint roller sleeve comprising:

(a) a first cylindrical insert dimensioned to frictionally engage the inside surface of one end of a paint roller sleeve, having a closed face at one end there of and a receiving bore extending coaxially inwardly from the other face thereof said bore including a circumferential detent of a larger radius than that of the receiving bore;

(b) a second cylindrical insert dimensioned to frictionally engage the inside surface of the other end of said paint roller sleeve having a bore extending coaxially entirely therethrough;

(c) a tubular axle member dimensioned to slide inside the bore of each said insert permitting rotation of each insert thereabout wherein one end of said axle member is provided with diametrically opposed holes in mating alignment with the circumferential detent of said first insert and the other end of said axle member is provided with an annular circumferential detent of smaller radius than said axle member located on said axle member to be positioned within the bore of said second cylindrical insert when rotatably mounted on said axle member;

(d) at least one retaining spring element having two opposing protrusions, said spring being compressible whereby said protrusions fit into the interior of said tubular axle member and released when the protrusions align with the holes of said tubular axle member to extend radially outwardly therethrough to spacedly engage the circuferential detent of said first insert when mounted on said tubular axle member;

(e) an o-ring sealing element disposed in said annular circumferential detent of said axle member whereby a rotatable seal is created between the axle member and the bore of said second cylindrical insert.

5. Apparatus as claimed in claim 4 wherein said first cylindrical insert further includes a conical receiving bezel on the opposite end of the cylinder from the closed face, said bezel extending in decreasing radius from the end of said insert conically coaxially inwardly aligning with said receiving bore thereof.

6. Apparatus as claimed in claim 4 or 5 wherein said retaining spring element is provided with an end cap element fixedly attached thereto forming a revolution surface having a cylindrical portion and shoulder portion, said cylindrical portion adapted to be slideably received by said tubular axle and shoulder portion to mate with that end of said tubular axle provided with said diametrically opposed holes.

7. A paint roller and extension pole system comprising:

(a) a cylindrical insert dimensioned to frictionally engage the inside surface of one end of a paint roller sleeve, having a closed face at one end there of and a receiving bore extending coaxially inwardly from the other face thereof said bore including a circumferential detent of a larger radius than that of the receiving bore;

(b) a tubular axle member dimensioned to slide inside the bore said cylindrical insert permitting rotation of said insert thereabout wherein one end of said axle member is provided with diametrically opposed holes in mating alignment with the circumferential detent of said first insert;

(c) a retaining spring element having two opposing protrusions, said spring being compressible whereby said protrusions fit into the interior of said tubular axle member and released when the protrusions align with the holes of said tubular axle member to extend radially outwardly therethrough to spacedly engage the circuferential detent of said first insert when mounted on said tubular axle member;

(d) an elongated grip engaging member having a keyed element extending from one end thereof adapted to slideably receive a mating keyed element provided on the grip of paint roller handle, including securing means to secure said keyed element of said grip engaging member to said mating keyed element provided on the grip of said paint roller handle in place;

(e) an elongated pole engaging member one end of which being adapted to slideably receive an extension pole therein, said pole engaging member further including securing means to secure said pole in place when inserted into said pole engaging member, said elongated pole engaging member having a swivel joint at the other end thereof;

(f) a swivel joint assembly connected to said grip engaging member and said pole engaging member whereby a selected relative angle between the two elongated members may be set including adjustable locking means operable to lock the selected angle set between the two elongated members.

* * * * *